US008898986B1

(12) United States Patent
Underkofler et al.

(10) Patent No.: US 8,898,986 B1
(45) Date of Patent: Dec. 2, 2014

(54) HANGER BAR

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 14/076,293

(22) Filed: Nov. 11, 2013

(51) Int. Cl.
*E04B 9/00* (2006.01)
*E04C 3/07* (2006.01)
*E04B 9/06* (2006.01)

(52) U.S. Cl.
CPC .. *E04B 9/067* (2013.01); *E04C 3/07* (2013.01)
USPC ..... 52/506.07

(58) Field of Classification Search
USPC ..... 52/506.06, 506.07, 506.08, 657, 509, 52/511
See application file for complete search history.

(56) References Cited

U.S. PATENT DOCUMENTS 7,578,107 B2 8/2009 Platt
2008/0060306 A1 * 3/2008 Platt et al. ..... 52/506.06

* cited by examiner

*Primary Examiner* — Mark Wendell
*Assistant Examiner* — Keith Minter
(74) *Attorney, Agent, or Firm* — Pearne & Gordon LLP

(57) ABSTRACT

A runner hanger comprising a metal strip having a plurality of spaced upper holes, a lower portion including a lower edge interrupted by a series of regularly spaced notches, the notches being configured to receive a hollow reinforcing bulb of a grid runner extending transversely to the hanger, the notch having a pair of longitudinally spaced ledges configured to support the bottom sides of a reinforcing bulb, the notches having a bendable tab carrying one of the ledges, the tabs being precision machine bent at an angle relative to a plane of the lower portion that allows a grid runner reinforcing bulb to be inserted when tilted in the associated notch and prevents the bulb from falling out of the notch when the runner is upright.

11 Claims, 4 Drawing Sheets

HANGER BAR

BACKGROUND OF THE INVENTION

The invention relates to suspended ceiling construction and, more particularly, to a main runner hanger bar.

PRIOR ART

So-called island or cloud ceilings are used by architects to define or distinguish a space from a surrounding area. Such ceilings can utilize a grid of through and cross runners, sometimes called tees, in combination with rectangular acoustical panels or parallel runners to which drywall is attached. Hanger elements have been developed to augment the rigidity of a grid or otherwise support the runners. An example of a prior grid runner hanger is disclosed in U.S. Pat. No. 7,578,107. This prior art hanger has longitudinally spaced notches that receive the reinforcing bulb of main runners and apertures for receiving screws to attach the hanger to cross runners. A problem with this hanger is that it requires manual reconfiguration by an installer at a job site of a part of the notch for reception of a bulb and then manual restoring of the reconfigured part to its original position. This manual reconfiguration and restoring adds to installation time. More subtle but of significant influence on the ease of installation of main runners on the hanger is the irregular or wholly absent ability of a notch to temporarily hold a grid runner in place once received in a field opened notch. When the notch part is provisionally bent to accept a grid runner, its configuration allows the grid runner to slip out of the notch when an attempt is made to initially install the same grid runner in a notch of another hanger spaced along the length of the grid runner. It can be impractical to fully restrain a bulb in a notch by bending the displaced part of the notch back into a positive bulb gripping position before a bulb is received in a notch of a next adjacent hanger.

SUMMARY OF THE INVENTION

The invention provides improvements in grid runner hangers that afford greater ease and speed of installation of the grid runners. The disclosed hanger can be used to support main runners in installations with or without cross runners.

The disclosed hanger, formed of malleable sheet metal, receives the hollow reinforcing bulb of a conventional grid runner or tee. The bulb is received in a specially formed notch or opening of the hanger. The notch has a profile which when its boundary is planar, is substantially closed and adapted to securely capture the reinforcing bulb and thereby locally support the respective grid runner.

A bendable tab constituting a portion of the notch profile can be bent out of the plane of the hanger to allow lateral passage of the bulb into the notch space. Once received in the notch space, the tab can be bent back into the plane of the hanger at the notch area to lock the bulb in the notch.

The tab can advantageously be pre-bent out of the notch area plane during its manufacture. A machine-made bend permits the tab to be precisely located with respect to the opposed areas of the notch. This precision, in turn, allows the tab to be located where it readily admits the bulb to the notch space, but retains the bulb from falling out of the notch space. Accidental release could otherwise occur when, for example, the suspension system is bumped or the grid runner as it is being installed in other hangers bends or otherwise develops a force tending to knock the bulb out of a notch space. It is desirable that a runner be installed in all of the notches assigned to it before any of the tabs are bent back into the notch space plane. This allows a twist in the grid runner necessary for insertion into a slot to be distributed lengthwise through adjacent hangers. The tab in its pre-bent position is preferably located so that a throat formed between the tab and an opposed edge of the notch, when viewed perpendicularly to the hanger, is generally equal to the width of the bulb.

The disclosed tab is joined to the hanger proper by two land areas separated by an elongated slot. The length of the slot is substantially greater than the combined length of the lands, measured in the same direction. This feature allows the tab to be consistently bent and straightened on a known line so that the performance of the bulb gripping and releasing action is uniform.

The profile of the notch at its upper region departs from that of the grid runner bulb. This region is configured to allow passage of a bulb that has collapsed upwardly as a result of being field cut with a tin snips or other shearing tool. The disclosed notch profile allows a field cut runner end to be longitudinally passed freely through the notch even where the bendable tab is in a notch closing position. Shoulders in the notch profile limit vertical displacement of a runner relative to the hanger bar once a bulb is installed therein.

DESCRIPTION OF THE PREFERRED EMBODIMENT

Figure 2:
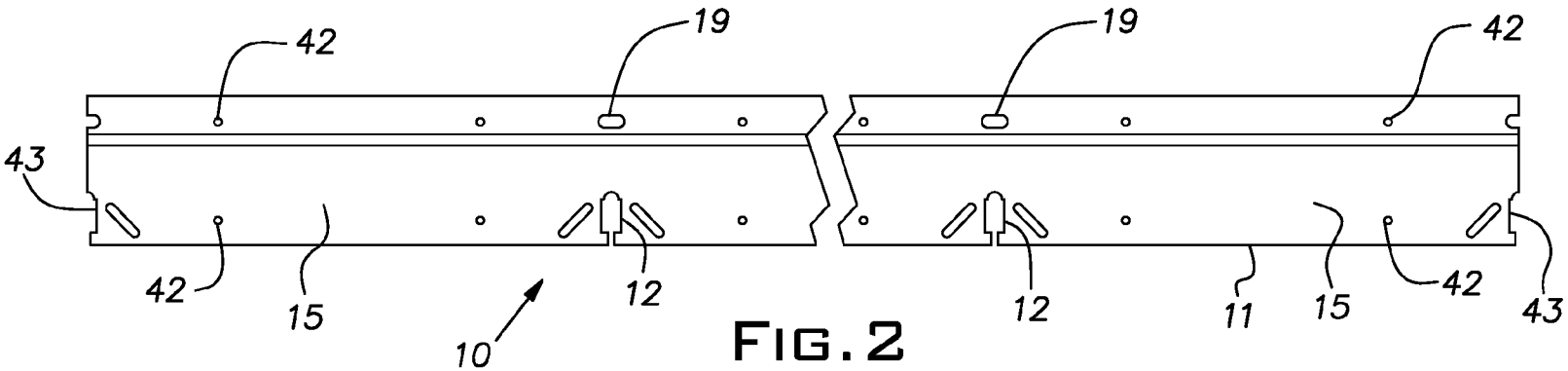
FIG. 2 is a fragmentary elevational view of the hanger.
Figure 3:
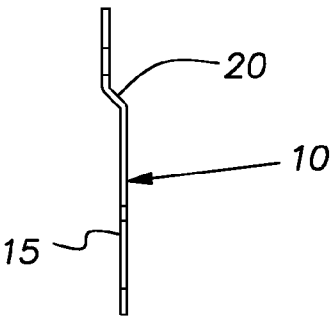
FIG. 3 is an end view of the hanger.

An example of a hanger or stabilizer bar 10 embodying the invention is illustrates in FIGS. 2 and 3. The hanger 10 is an elongated sheet metal strip formed, for example, of malleable hot dipped galvanized steel, with a thickness or gauge of 0.046 inches. The illustrated hanger strip has a length of 9 foot 6 inches, and a height of 2¼ inches, it being understood that these dimensions are appropriately modified for use in standard metric dimensioned grid components.

An upper margin of the hanger 10 has longitudinally spaced holes 19 for receiving suspension wire for supporting the hanger from superstructure. A lower edge 11 of the hanger 10 has a series of regularly spaced notches 12. The notch spacing can be 8 inches on center making it compatible with grid runner systems on 16 inch and 24 inch centers. Metric systems can be similarly dimensioned. As shown in FIG. 3, a mid-section of the hanger 10 has a stiffening bend 20.

Each notch 12, shown on a larger scale in FIGS. 4-7, has a re-entrant profile symmetrical about a vertical center line such that its horizontal width away from the edge 11 is greater than at the edge. More specifically, an inward portion 13 of a notch 12 is configured to receive a reinforcing bulb 14 of a grid tee or runner 16. A narrow notch portion 17 at the edge 11 is configured to receive a web 18 of a grid runner existing below the bulb 14.

Figure 5:
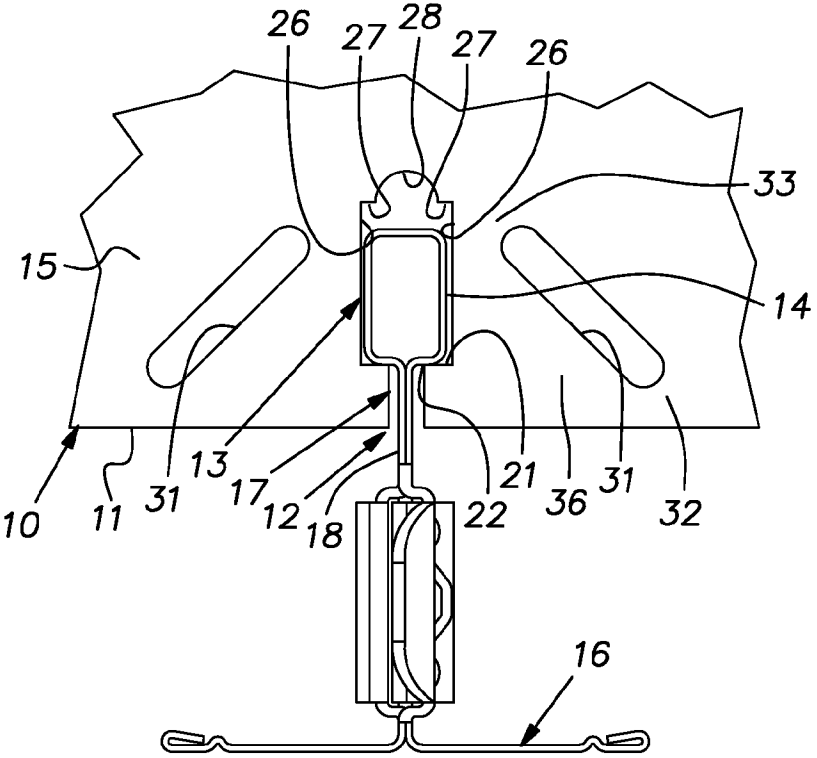
FIG. 5 is a view of a notch area showing a tab in the plane of the hanger where it serves to fully restrain and support a grid runner.

FIG. 5 most clearly illustrates the profile of the notch 12 in a final grid runner supporting configuration. The notch profile has bulb supporting ledges 21 on its opposite sides, which bear against parts 22 of a lower face of a reinforcing bulb 14 to enable the hanger 10 to carry the grid runner or tee 16. Vertical sides 26 of the notch 12 extend above the height of a bulb 14 carried on the ledges 21. The width of the notch 12 is narrowed above a pair of abutments 27 formed by downwardly facing edge portions. The abutments 27 are spaced above the ledges 21 a distance greater than the height of the bulb 14. The top of a notch 12 is bounded by an arcuate edge 28, the apex of which is at least 1⅓ of the height of the bulb 14.

On each side of the notch 12 is an elongated inclined through slot 31. A short land 32, 33 of the hanger material exists between the slot and the edge and the notch 11 and 12, respectively. Each slot 31 makes a line of weakness indicated by a broken line 34 in FIG. 4 and results in a triangular tab 36 bounded by the slot 31, edge 11, and notch 12.

The narrow part of the notch 12 adjacent the lower hanger edge 11, when the tab 36 is planar with the remainder of the lower portion, designated 15, of the hanger, is too small to permit a reinforcing bulb to be assembled into the notch 12 with generally vertical or upward movement of the bulb 14, i.e. lateral movement of the runner 16, relative to the hanger 10.

Figure 4:
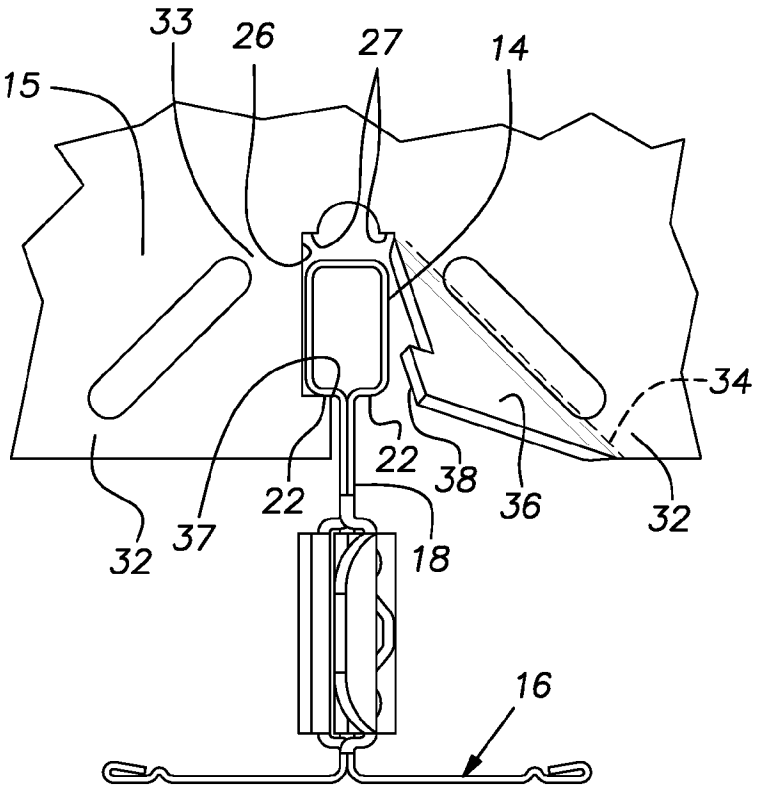
FIG. 4 is a fragmentary view of a notch area of the hanger with a tab of the notch precision bent out of the plane of the hanger to allow and maintain assembly of a grid runner in the notch.

In accordance with one aspect of the invention, the hanger 10 is manufactured with one of the tabs 36 at each notch 12 precision machine-bent at the line of weakness 34 to an angle with respect to the hanger lower portion 15. For the geometry and proportions of the illustrated notch 12, this bend angle is, for example, between about 50 to about 70 degrees. FIG. 4 illustrates a tab 36 bent or folded to this angle.

In the bent position of the tab 36, the minimum distance between a corner 37 formed at the intersection of a ledge 21 and the narrow portion 17 of the notch 12 and an edge 38 of the adjacent bent tab 36 is the same or slightly less than the width of the reinforcing bulb 14 (FIG. 4). More accurately, it is the distance between the described corner 37 and a projection of the bent tab edge 38 to the plane of the hanger lower portion 15.

Figure 1:
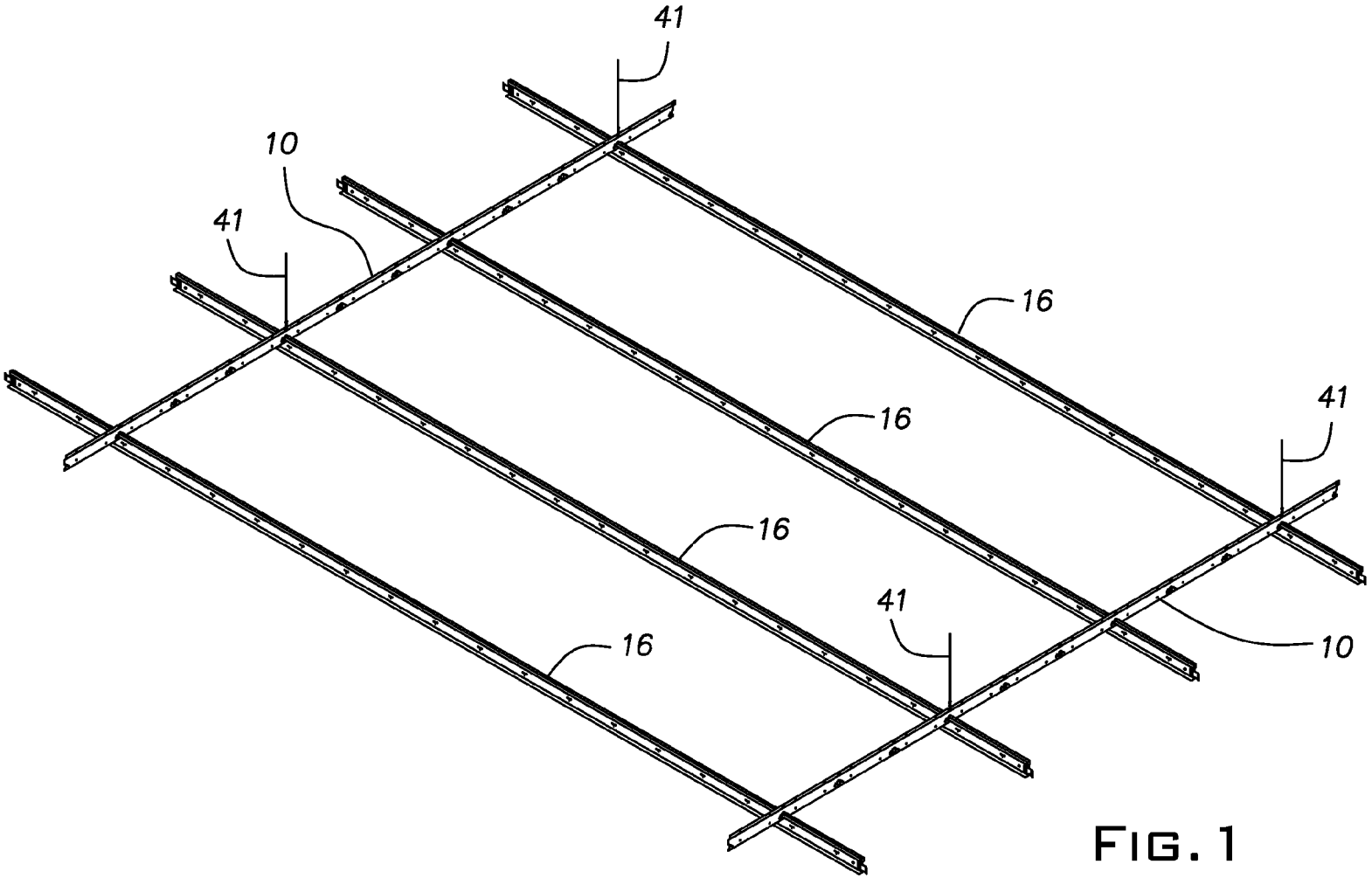
FIG. 1 is an isometric view, from above, of a suspended grid employing the grid runner hanger of the invention.

When the hangers 10 are used in a ceiling construction, they can be suspended by wires 41, or rigid brackets (not shown), in spaced parallel relation in a common horizontal plane, as depicted in FIG. 1. Thereafter, the grid runners 16, in the form of main runners, typically having a length of 12 feet (or metric equivalent), are installed on the hangers 10 from below. For installation, a grid runner 16 is tilted from an upright position and raised laterally with reference to the runner into a notch 12 where, as shown in FIG. 4, one of the tabs 36, as it is shipped from the factory, is precision machine bent out of the plane of the hanger lower portion 15. The bulb 14 is inserted through the gap between the corner 37 and edge 38 of the tab 36. Little or no resistance is encountered by the bulb 14 since interference with the tab 36, if any, is overcome by slight resilient deflection of the tab and/or bulb. Once the bulb 14 is fully received in the inward portion 13 of the notch 12 and is released by the installer, the grid runner 16 under the influence of gravity assumes an upright position as shown in FIG. 4. Thereafter, the grid runner 16 can be assembled in the next adjacent hanger 10 in the manner described. When the runner 16 is twisted from the vertical to insert it into the next hanger 10, the bent tab 36 of the last notch will retain the bulb 14 in its associated notch 12 and prevent it from falling from the last hanger 10. The bent tabs 36 are, additionally, effective to prevent a runner 16 from dropping out of the notches 12 when the grid under construction is bumped or otherwise disturbed.

After a length of grid runner 16 has been installed on a plurality of hangers 10, the bent tabs 36 associated with the runner can be manually bent back by the installer into the plane of the hanger lower portion 15 to lock the bulb 14 in the respective notches 12. The elongated slot 31 of the tabs 36 makes the re-bending intuitive and assures that it will reliably occur on the line of weakness 34.

Figure 7:
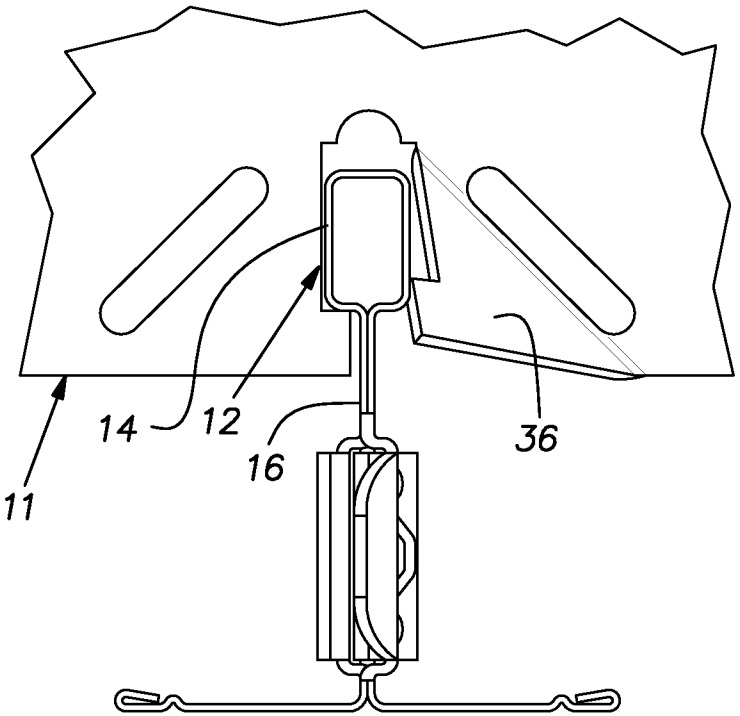
FIG. 7 illustrates a tab in an under-bent position.
Figure 6:
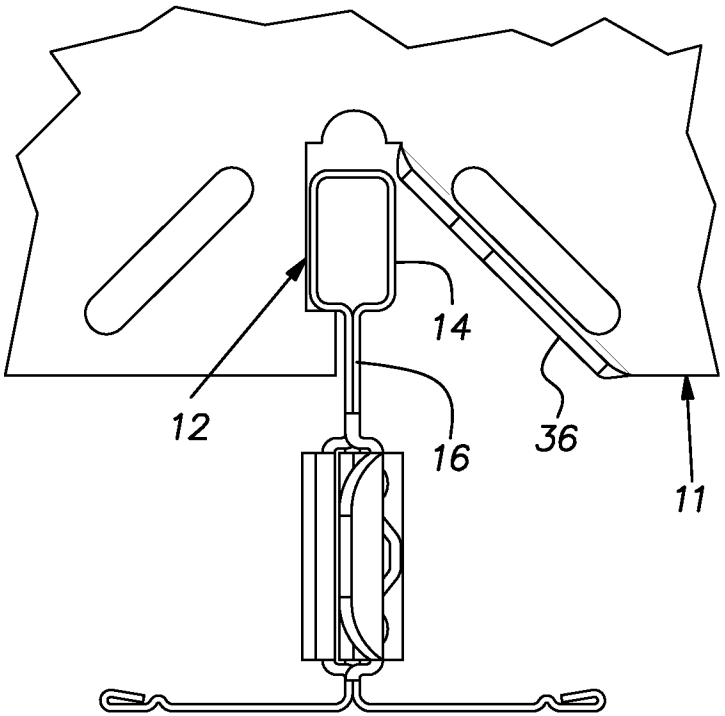
FIG. 6 illustrates a tab in an over-bent position.

FIG. 6 illustrates a condition where a tab 36 is over-bent with the result that a grid runner 16 cannot be reliably retained in a notch 12. For example, where either the grid runner 16 or hanger 10 is bumped, the grid runner has a tendency to fall out of the notch 12. FIG. 7 illustrates a condition where the tab is under-bent at say 45 degrees. In this tab position, it is relatively difficult to assemble a grid runner bulb 14 in a notch 12 from below the edge 11 since the free edge of the tab 36 obstructs entry of a bulb into the notch.

Figure 8:
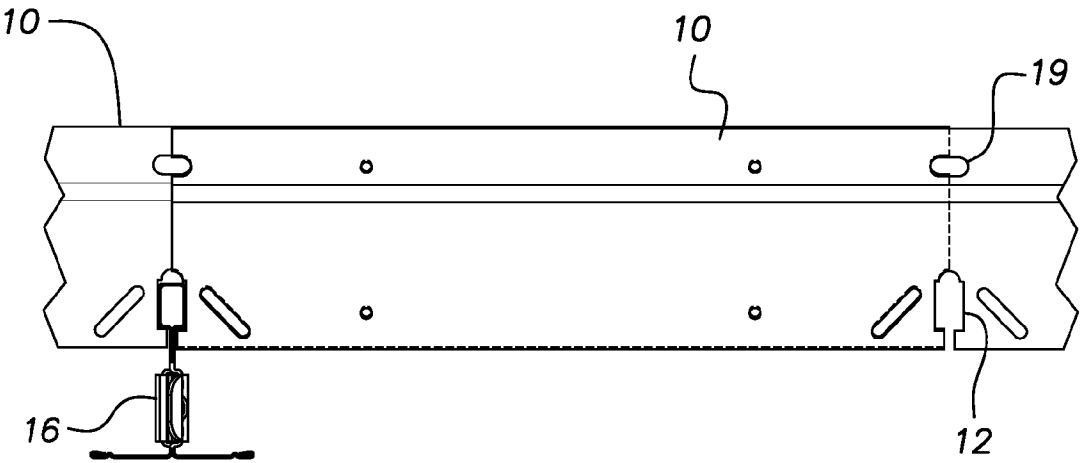
FIG. 8 is a fragmentary side view of a pair of lap joined hangers.

The abutments 27 limit upward movement of a grid runner by stopping the bulb 14 from rising excessively in the notch 12. The notch profile provided by the arc 28 is sufficiently high to allow passage of a bulb 14 that is cut and typically crushed with a tin snips or like tool. Longitudinal movement of a grid runner 16 in a notch 12 can be necessitated, for example, by certain field conditions.

Where a length of a hanger 10 is insufficient to extend across a ceiling width or length, another hanger or hangers or a portion of a hanger can be joined in a lap joint. The end of each additional hanger 10 can be overlaid on the end of a previously installed hanger 10 so that a half notch 43 at the end of the additional hanger aligns with the last full notch 12 of the previously installed hanger. The quasi Z or S cross-section of the hanger 10 shown in FIG. 3 allows the ends of adjacent hangers to be lapped directly against one another with full surface contact in a manner illustrated in FIG. 8. The half notch 43 can facilitate and speed up the erection of a grid because it can be used to index an end of a hanger 10 being installed both vertically and endwise when the half notch abuts a bulb 14 of a runner 16 that has first been installed in the last full notch 12 of the preceding hanger. Holes 42 provided in the hanger 10 will overlie one another when a proper lap joint is made and can receive screws for fixing the lapped layers together.

While the illustrated grid runners 16 are of a type used for suspending drywall, grid runners of other cross-sectional shape that include an upper reinforcing bulb, such as grid tees used with lay-in panels or the open slot type, can be used with the disclosed hangers 10. Further, the hanger 10 can be used with grid arrangements having cross runners between the main runners and the holes 42 adjacent the lower edge 11 can be used with self-drilling screws to attach the hanger to the cross runners. Each notch 12 can be provided with only one bendable tab 36 and the slot 31 on the opposite side of the notch can be omitted. In some installations, such as in a corridor, only one hanger running down the center of the corridor may be needed.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspension ceiling runner hanger comprising an elongated malleable sheet metal strip having a plurality of spaced holes adjacent an upper longitudinal margin, a lower portion including a lower edge and a longitudinal bend above the lower portion, the lower edge being interrupted by a series of regularly spaced notches disposed along substantially the full length of the hanger, the notches being configured to receive a hollow reinforcing bulb of a grid runner extending transversely to the hanger, the notch having a pair of longitudinally spaced ledges configured to support the bottom sides of a reinforcing bulb received in the notch, each of the plurality of notches having a precision machine bent tab for carrying one of the ledges, the precision machine bent tabs being disposed at an angle relative to a plane of the lower portion that allows a grid runner reinforcing bulb to be inserted when tilted in the associated notch by lateral movement of the runner from a position below the lower edge upwardly into the notch, the tab in the precision machine bent position preventing the reinforcing bulb from falling out of the notch when the runner is upright, the tab being joined to the hanger lower portion proper at a line of weakness that allows the tab to be manually bent back into a plane of the hanger lower portion.

2. A hanger as set forth in claim 1, wherein said line of weakness is formed on the lower portion at an angle with respect to the lower edge of the lower portion.

3. A hanger as set forth in claim 2, wherein said line of weakness is formed by an elongated slot.

4. A hanger as set forth in claim 3, wherein said slot lies between land areas of the lower portion, said land areas measured in the direction of the line of weakness when combined are less in length than said slot.

5. A hanger as set forth in claim 1, wherein said notch has a narrow entrance and a widened interior.

6. A hanger as set forth in claim 5, wherein said ledges are formed by a pair of generally horizontal edges of said notch.

7. A hanger as set forth in claim 6, wherein said widened interior includes a pair of spaced stop edges arranged to limit upward movement of the bulb in the notch.

8. A hanger as set forth in claim 7, wherein said widened interior includes an area above said stop edges of a height sufficient to provide clearance for longitudinal passage of a crushed end of a reinforcing bulb cut by a tin snips.

9. A method of erecting a grid for a suspended ceiling comprising suspending a plurality of straight elongated malleable metal hangers in spaced parallel relation, the hangers being provided with regularly spaced notches on lower edges thereof, each notch being configured with an interior enlarged relative to a notch opening at the lower edge whereby the notch is adapted to receive and vertically support a bulb of a grid runner, the notches of the plurality of hangers being aligned in rows perpendicular to the hangers, the hangers being provided with a bendable tab associated with each notch for widening the opening when the tab is out of a plane of a lower portion of the hanger, passing a grid runner bulb into successive notches of successive hangers by raising the bulb through an opening resulting from the respective tab being previously bent out of the plane of the lower portion of the hanger, and after the grid runner is received in a plurality of notches, manually bending the tabs back into the plane of the lower portion of the hangers, the tabs being precision machine bent to said angle during manufacture of said hanger.

10. A hanger formed of an elongated sheet metal strip having lower and upper longitudinal edges, the lower edge having a plurality of regularly spaced re-entrant notches adapted to support the reinforcing bulb of a grid runner, a plurality of regularly longitudinally spaced apertures adjacent the upper edge adapted to receive suspension wires, the hanger having a cross-section configured to be lapped with an identical hanger with substantially full contact between lapped areas, each end of the hanger having a half notch whereby the hanger can be indexed and lapped with another hanger carrying a grid runner reinforcing bulb in a full notch adjacent the associated end half notch of the other hanger.

11. A hanger as set forth in claim 10, wherein the notches are spaced 8 inches or metric equivalent apart.

* * * * *